US006251036B1

(12) United States Patent
Wu et al.

(10) Patent No.: US 6,251,036 B1
(45) Date of Patent: Jun. 26, 2001

(54) CARBON FIBER ARROW AND CONTINUOUSLY WINDING METHOD THEREOF

(75) Inventors: Xiang Wu; Qingzhu Mao; Wenhao Chen; Dahai Sun; Minyong Liu; Weifang Chen, all of Beijing (CN)

(73) Assignee: Beijing Institute of Aeronautical Materials, Beijing (CH)

( * ) Notice: Subject to any disclaimer, the term of this patent is extended or adjusted under 35 U.S.C. 154(b) by 0 days.

(21) Appl. No.: 09/516,576

(22) Filed: Mar. 1, 2000

(30) Foreign Application Priority Data

Mar. 25, 1999 (CN) ..... 99103184

(51) Int. Cl.[7] ..... F42B 6/04
(52) U.S. Cl. ..... 473/578
(58) Field of Search ..... 473/578, FOR 216

(56) References Cited

U.S. PATENT DOCUMENTS

| | | | | |
|---|---|---|---|---|
| 2,694,661 | * | 11/1954 | Meyer | 473/578 X |
| 4,234,190 | | 11/1980 | Airhart . | |
| 5,273,293 | * | 12/1993 | Lekavich | 473/578 |
| 5,788,585 | | 8/1998 | Jackson | 473/292 |

FOREIGN PATENT DOCUMENTS

| | | | | |
|---|---|---|---|---|
| 0 529 164 A1 | | 3/1993 | (EP) . | |
| 2689228 | * | 10/1993 | (FR) | 473/FOR 216 |
| 3155880 | * | 7/1991 | (JP) | 473/FOR 216 |
| 1675649 | * | 9/1991 | (SU) | 473/FOR 216 |

* cited by examiner

*Primary Examiner*—John A. Ricci
(74) *Attorney, Agent, or Firm*—Cook, Alex, McFarron, Manzo, Cummings & Mehler, Ltd.

(57) ABSTRACT

A carbon fiber arrow shaft comprises a hollow tube, a reinforced carbon fiber, and a resinoid binder. The hollow tube has a length between 500–900 mm, an inner diameter between 2–10 mm, and a tube wall thickness between 0.3–2 mm. The reinforced carbon fiber and the resinoid binder form a resin-impregnated carbon fiber. The carbon fiber arrow shaft is formed by directly and continuously winding the resin-impregnated carbon fiber around the hollow tube. The carbon fiber arrow shaft has a head section (L1), a middle section (L2) and a tail section (L3). A winding angle of the carbon fiber at the head section (L1) is changed from a larger winding angle to a smaller winding angle, a winding angle at the middle section (L2) stays constant, and a winding angle at the tail section (L3) is changed from a smaller winding angle to a larger winding angle. The lengths of the head section (L1) and the tail section (L3) are between 25–250 mm. The initial winding angle at the head section (L1) is between 30–90 degrees and is gradually decreased to between 2–30 degrees at the boundary of the head section (L1) and the middle section (L2). The winding angle at the middle section (L2) stays constant, and the winding angle at the tail section (L3) is gradually increased from between 2–30 degrees at the boundary of the middle section (L2) and the tail section to between 30–90 degrees at the end of the tail section (L3). The peripherally located winding angles at both the head section (L1) and the tail section (L3) are at least two times the winding angle at the middle section (L2). The shaft provides uniformity of wall thickness and eliminates overlapping joints or surface protrusions.

4 Claims, 1 Drawing Sheet

CARBON FIBER ARROW AND CONTINUOUSLY WINDING METHOD THEREOF

BACKGROUND OF THE INVENTION

The present invention belongs to the field of carbon fiber composite material technology and relates to an improvement for a carbon fiber arrow shaft.

Prior arrow shafts include wooden arrow shafts, aluminum arrow shafts and carbon fiber arrow shafts. Wooden shafts have heavier masses and are not uniform thus influencing their effect on usage. Aluminum arrow shafts have lower masses but they have poor stiffness and are subject to permanent deformations. Glass fiber arrow shafts have less strength and are easily broken.

The appearance of the carbon fiber reinforced material has introduced advanced composite material into sports equipment. Such material has superior performances: lighter masses, higher strengths, and good stiffness. In making current carbon fiber arrow shafts, both carbon fibers and resins initially form a pre-impregnated material, which is then cut and twist-wound onto mandrels, and then formalized by thermosetting. Due to the overlapping joints of pre-impregnated material, surface protrusions are easily formed which affect the uniformity of arrow shafts. The non-uniform shaft wall thickness will affect the uniformity of forces applied to arrow shafts, thus resulting in bending and deformation of the shafts, and lowering the linearity of the shaft. The non-uniform shaft wall thickness will result in instability of the flight path of the arrow.

Within a certain period after shooting of the arrow, besides forward movement, the arrow shaft will have radial vibration which becomes weaker due to the damping produced by the arrow shaft stiffness and which approaches zero after a certain period of time. If the shaft wall thickness is not uniform, the stiffness along each radius direction is not symmetrical which results in an imbalance of the damping effect. The imbalanced damping will affect the motion of the arrow producing some unexpected changes in the flight path. Moreover, the arrow that is in flight will be subject to air resistance which will result in deflection from the flight path when the shaft wall thickness is non-uniform. Therefore, the non-uniform shaft wall thickness will increase the aiming errors.

U.S. Pat. No. 4,234,190 entitled "Carbon Fiber-Reinforced Plastic Arrow" has disclosed an improved carbon fiber arrow shaft (FIG. 1), which has a two-layered construction. The interior layer 12,14 utilizes a winding method, which comprises two oppositely wound carbon fiber winding layers with a winding angle between 30–45 degrees. The outer layer 16 is made by twist-winding of one to four layers of 0 degree pre-impregnated fiber material. The performance of such an arrow shaft construction are higher than those of an arrow shaft formed by complete twist-winding. However, due to the need of twist-winding one to four layers of 0 degree fiber to increase its strength, the protrusions appearing on the surface cannot be avoided. This will result in a non-uniform shaft wall thickness. Furthermore, the thickness of the carbon fibers wound on the inner layer of the arrow shaft is small such that the twist-resistance and shear-resistance are poor. When the arrow shafts are shot or aimed at the targets, the impact on hard material objects causes the two ends of the shafts to be easily cracked or broken due to greater forces imposed thereon.

One disadvantage of the manufacture technology with respect to the above-mentioned "Carbon Fiber-Reinforced Plastic Arrow" is the need for two steps in formalizing the carbon fiber tubes. The interior layer is processed on winding machines, while the outer layer is processed on twist-winding machines. Moreover, the twist-winding needs pre-impregnated materials. Thus, in the winding and twist-winding technological procedures, two fiber raw materials, namely carbon fibers and pre-impregnated materials, are needed. This results in complexity of technology, discontinuity of winding, high costs and low production efficiency.

Based on the usage features of the arrow shaft, the requirements for the stiffness at the two ends of shafts and at the central part of the shafts are different. For an ideal arrow shaft, the central part or middle section of the shaft needs a greater degree of stiffness than at the ends. Thus, when the arrow is launched, the deformation of the shaft during flight is small, the flight path is stable, and aiming precision is higher. There are large forces imposed on the arrow shaft head and tail ends during launch and impact, such that the two ends are easily cracked. Therefore, appropriate elasticity, flexibility and enough circumferential strength are needed.

SUMMARY OF THE INVENTION

The object of this invention is to provide a carbon fiber arrow shaft, which has a reasonable construction, meets the requirements for stiffness distribution of the arrow shaft and has uniform shaft wall thickness, thereby overcoming the weakness of the conventional carbon fiber arrow shafts, i.e., non-uniformity of shaft wall thickness, unreasonable stiffness distribution and low performances.

Another object of the present invention is to provide a directly and continuously winding method for a carbon fiber arrow shaft, which guarantees a uniform shaft wall thickness and strength thereof, and which increases productivity and decreases cost.

According to the present invention, a carbon fiber arrow shaft has a hollow tube formed with a length of between 500–900 mm, an inner diameter of between 2–10 mm, and a tube wall thickness of between 0.3–2 mm. A carbon fiber is used as a reinforced material and a resinoid is used as a binder. The arrow shaft is formed by directly and continuously winding the resin-impregnated carbon fibers. The winding angle of the carbon fiber at a head section (L1) is shown as being changed from a large winding angle to a small winding angle, a winding angle at a middle section (L2) is kept constant and a winding angle at a tail section (L3) is changed from a small winding angle to a large winding angle. The length of the head section (L1) is between 25–250 mm with the initial winding angle at the head section (L1) being between 30–90 degress and the winding angle at the head section (L1) is gradually decreased to between 2–30 degrees at the boundary of the head section (L1) and the middle section (L2). In the middle section (L2), the winding angle is kept constant. The length at the tail section (L3) is between 25–250 mm with the winding angle at the tail section (L3) being gradually increased to between 30-90 degrees at the end of the tail section (L3). The winding angles at the head section (L1) and the tail section (L3) are at least two times of the winding angle at the middle section (L2).

A continuously winding method for a carbon fiber arrow shaft includes the following steps:

(1) selecting the materials of a carbon fiber and a binder wherein 3K–24K carbon fiber is used as a reinforced material and a themoset epoxy is used as a binder for the winding of arrow shafts;

(2) setting up the winding program for a winding machine as follows: the full length of the arrow shaft is divided into three sections, i.e. a head section (L1), a middle section (L2) and a tail section (L3), the length of the head section (L1) being between 25–250 mm, and the length of the tail section (L3) being between 25–250 mm; the initial winding angles at the head section (L1) being set between 30–90 degrees, and being gradually decreased to between 2–30 degrees at the boundary of the head section (L1) and the middle section (L2); the winding angle at the middle section (L2) being kept constant; the winding angle at the tail section (L3) being gradually increased from the range of 2–30 degrees at the boundary of the middle section (L2) and the tail section (L3) to the range of 30–90 degrees at the end of the tail section (L3) and the winding angles of the head section (L1) and the tail section (L3) being at least two times of that of the middle section (L2);

(3) initiating the winding machine to form a carbon fiber arrow shaft blank by continuously and directly winding the carbon fiber on an arrow shaft mandrel according to present winding program;

(4) unloading the arrow shaft blank from the winding machine.

The advantages of the carbon fiber arrow shaft according to the invention are as follows:

1. Low weight: The weight per centimeter of length of the arrow shaft is only 0.22±0.1 g.
2. Good linearity: Total linearity (T. I. R) approaches 0.025 mm (0.1‰in). The total thickness is uniform. There is no bending and deformation of the shaft to get stable and accurate shooting.
3. Reasonable distribution of stiffness: The shaft at the middle section has high stiffness and undergoes minimal deformation upon the application of force. Each of the two ends of the arrow have effective twist-resistance and shear-resistance and have sufficient circumferential strength. The shaft will not crack under greater forces. The different requirements for flexibility and stiffness at each section of the shaft are met.
4. Uniform material and uniform wall thickness are achieved without overlapping joints of the carbon fibers and the surface protrusions therefrom.

As compared with the prior methods, the advantages of the continuous winding method for the carbon fiber arrow shaft of the present invention are as follows:

1. The quality requirements for the arrow shaft are assured, and the production of carbon fiber arrow shafts enables high performance thereof.
2. The stiffness of the arrow shafts is controlled through regulating the winding angles according to the customer requirements.
3. Continuous winding provides simplicity of technology, saves equipment, simplifies materials and increases efficiency.
4. Production costs are lowered.

DETAILED DESCRIPTION OF THE INVENTION

Figure 1:
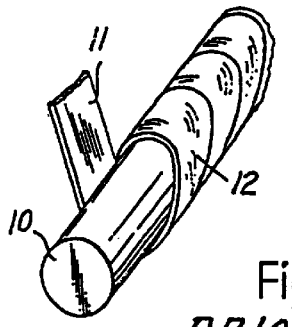
Fig. 1 (a) PRIOR ART
FIGS. 1*a* to 1*c* is a schematic view of the structure of the arrow shaft according to U.S. Pat. No. 4,234,190.
Figure 1:
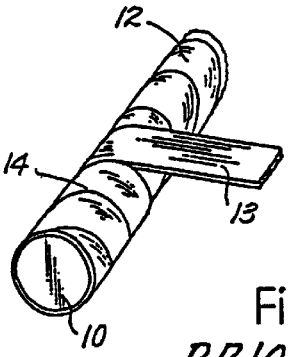
Fig. 1 (b) PRIOR ART
Figure 1:
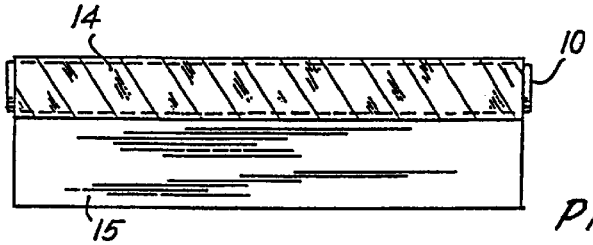
Fig. 1 (c) PRIOR ART
Figure 2:
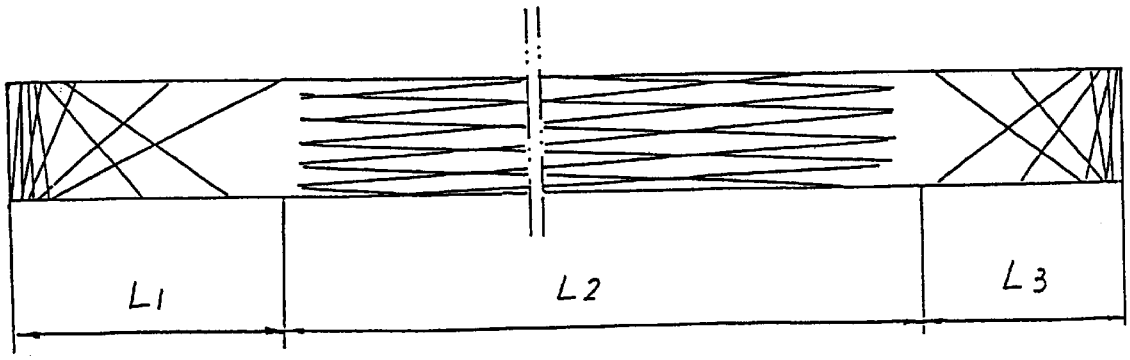
FIG. 2 is a schematic view of the winding structure of carbon fiber of the arrow shaft according to the present invention.

FIG. 2 shows the winding construction of the carbon fiber arrow shaft according to the invention. The carbon shaft arrow shaft is formed by continuously winding resin-impregnated carbon fiber yarns. The quality of the outer and interior material of the tube wall is uniform and the arrow shaft wall has uniform thickness due to a single layer construction which avoids overlapping joints of carbon fibers and the surface protrusions produced therefrom.

The arrow shaft has two ends each having large winding angles of carbon fiber so as to increase the strength of twist and shear strength, and to increase resistence to cracking. An arrow shaft middle portion has a small winding angle of carbon fiber, down to 2 degrees (approximate to zero degrees). The stiffness at the middle portion is much greater than that at the two ends and meets the requirements of stiffness and elasticity for the middle portion of the arrow shaft. By regulating the winding angles of the carbon fiber, the stiffness and the flexibility of the arrow shaft can be conveniently regulated. Smaller winding angles add greater stiffness to the arrow shaft, so that the shaft is hard to deform. Conversely, larger winding angles increase the flexibility of the shafts and have poor stiffness. Although the stiffness of the shaft at the two ends of the arrow shaft is lower than that at the middle portion, the stiffness at the two ends still meets the requirements of design and usage completely because there is an arrow head at the head section of the shaft and a tail feather at the tail section to impart local strengthening effects. On the other hand, the increase in crack resistance at the two ends avoids or decreases the damage to the arrow shaft due to the forces acting thereon thus increasing the service life of the arrow shafts. Therefore, the present invention has a more effective distribution of strengths than prior carbon fiber arrow shafts.

More particularly, the winding angles of the carbon fiber are changed along the full length of arrow shaft, from a larger winding angle to a smaller winding angle, and then, from a smaller winding angle to a larger winding angle. Each arrow shaft is divided into three sections according to different values of winding angles: a head section L1, a middle section L2 and a tail section L3. The winding angle at the head section L1 of the arrow shaft is changed from a larger winding angle to a smaller winding angle. At the middle section L2, the winding angle is kept constant. At the tail section L3, the winding angle is changed from a smaller winding angle to a larger winding angle.

The length of the head section L1 is within the range of 25–250 mm and the head section L1 has an initial winding angle between 30–90 degrees and decreases gradually to between 2–30 degrees at the boundary of the head section L1 and the middle section L2, which is also the starting point of the middle section L2. At the middle section L2, the winding angle remains constant. The length of the tail section L3 is also within the range of 25–250 mm, but the winding angle is increased from the boundary of section L2 and the section L3, where the angle is between 2–30 degrees, to between 30–90 degrees at the end of the tail section L3. The winding angles at the head section L1 and the tail section L3 should be at least two times the winding angle at the middle section L2.

The selection of the length and the winding angle at the middle section L2 depends upon the pulling force and the stiffness of the arrow shaft required by the shooter. If the pulling force of the bow is large or the shooter requires an arrow shaft having good stiffness, the middle section L2 should be appropriately lengthened and have small winding angles. On the contrary, if the length of the middle section L2 is decreased and the winding angle at the middle section L2 is increased, the stiffness of the arrow will be decreased. Such an arrow is appropriate to bows with small pulling forces or with shooters who prefer softer arrows.

Once the length and winding angle of the middle section L2 are determined, the length and the winding angle of the head section L1 and the tail section L3 can be accordingly determined. Generally speaking, the lengths of the head section L1 and the tail section L3 may be equivalent. However, the winding angles at the head section L1 and the tail section L3 should be greater than or equal to two times that of the middle section L2. At the head section L1 and the tail section L3, greater winding angles yield higher circumferential strengths and lessen the local stiffness at the local part of the arrow shaft.

The following ranges are recommended. The length of the head section L1 is between 100–200 mm and the initial winding angle at the starting point of the head section L1 is between 40–60 degrees. The winding angle at the head section L1 is decreased gradually to between 5–10 degrees at the boundary of head section L1 and middle section L2. At the middle section L2, the winding angle is kept constant. The length of the tail section L3 is between 100–200 mm and the winding angle at the tail section L3 is increased gradually from the boundary of the middle section L2 and the tail section L3 to between 40–60 degrees at the end of the tail section L3.

In fact, the length and the winding angle of the carbon fiber at the head section L1 and the tail section L3 may be the same or different.

The method for continuously winding carbon fiber arrow shafts according to the invention comprises the following steps:

(1) Selecting the materials of the carbon fiber and the binder for the winding of the arrow shaft.

3K–24K carbon fiber yams are used as a reinforcing material and thermoset epoxy is used as the binder. Before winding onto the mandrels, the carbon fibers are impregnated with resin through a binder impregnating bath which is full of liquid epoxy and then they are transported into a winding machine. The winding machine may be chosen from various commercial ones, e.g. a WG 5-20 winding machine from the United States which can control winding angles for different sections by programming. The carbon fibers may be T-300 to T-700 fibers made in Japan or other carbon fibers with other models from other suppliers. A fine binder used with the carbon fiber yams increases the accuracy of the winding, yields a more compact texture, and improves the performance of the arrow shaft. However, if a fine binder of carbon fiber yams is used, the costs of the binder is higher, the productivity is lower and the cost of the arrow shaft is higher. Preferably, 6K–12K carbon fibers are used. The resin may be epoxy resin with two constituents, e.g., the American DER 826 epoxy resin and the Lindride curing agent. After compounding, the viscosity of the resin at 25° C. will be controlled to between 65–95 poise.

(2) Setting up the winding program for the winding machine.

First, the rule for changing the winding angles should be fixed. The shaft along the length is divided into three sections: a head section L1, a middle section L2, and a tail section L3. The length of the head section L1 is between 25–250 mm and the length of the tail section L3 is between 25–250 mm. The winding angle of the head section L1 is set to have an initial angle between 30–90 degrees, which is gradually decreased to the range of 2–30 degrees. The winding angle at the middle section L2 is kept constant. The winding angle of the section L3 is gradually increased from between 2–30 degrees to between 30–90 degrees. The winding angles of the head section L1 and the tail section L3 should be at least two times that of the winding angle of the middle section L2. Preferably, the length of the head section L1 is between 100–200 mm. The initial winding angle at the starting point of the head section L1 is between 40–60 degrees. The winding angle of the head section L1 is gradually decreased to between 5–10 degrees at the boundary of the head section L1 and the middle section L2. The winding angle at the middle section L2 is kept constant. The length of the tail section L3 is between 100–200 mm and the winding angle of the tail section L3 is gradually increased from the boundary of the middle section L2 and the tail section L3 with the winding angle at the end of the tail section L3 is between 40–60 degrees.

Then the required thickness of winding is set. The required number of windings for each winding layer is calculated according to the diameter and the dimension of the binder of the carbon fiber yarns and the number of the layers is calculated according to the wall thickness of the product arrow shaft and the thickness of each winding layer. The total number of windings can be obtained from the above two numbers. Of course, a thickness margin for grinding should be added. Different numbers of carbon fiber winding are required for different specifications of arrow shafts. Generally, somewhere between 25–50 windings of carbon fibers are needed.

The winding machine is programmed with the above data.

(3) Initiating the winding machine to form an arrow shaft blank by continuously winding carbon fibers on an arrow shaft mandrel according to the preset winding program.

After setting the winding programs, the winding machine is initiated and the machine automatically performs winding according to preset programs until the preset number of windings are finished. During winding, the rate of the change of the winding angle is determined by the winding machine and is substantially uniform.

(4) Unloading the wound arrow shaft blank from the winding machine.

The blanks are then processed by the steps of curing, mandrel-withdrawing, cutting, grinding etc., so as to form product arrow shafts. The steps after winding are well-known to the public so that no tedious descriptions are needed.

The following has to be further explained:

Since cutting is needed for the blanks of the arrow shaft to form products and the product arrows may be cut a little bit by the user to adapt the arrow to the arm length of the user, the winding angles of the carbon fiber of the arrow shafts at two ends cannot be accurately determined. However, they are within the preset ranges and are far greater than the winding angle at the middle section. Thus, the crack resistance of the arrow will not be affected. In order to ensure that the sections at the two ends of the product arrow shaft have larger winding angles, the lengths of the head section L1 and the tail section L3 may be increased appropriately, while keeping enough length at the middle section L2 so as to leave enough cutting margin.

The following shows the embodiments of the arrow shaft of the present invention and the winding method thereof. The basic steps of the winding method have been clearly described above. Therefore, only the main parameters for each embodiment are shown in the following tables.

Table 1 shows the examples of the construction parameters and performances of the arrow shaft of the invention.

The method for measuring the stiffness includes applying a load of 4.5 kg into the center of the arrow shaft where the span between the support points at the two ends is 235 mm, the radius of the support points is 12.7 mm, and the central deflection is between 0.5–3.8 mm, corresponding to a stiffness coefficient, which may also be referred to as the modulus of elasticity, having a range approximately between 67 to 500.

Table 2 shows the examples of the parameters for winding of the arrow shaft of the invention.

TABLE 1

Example of the Construction Parameters and Performances of the Arrow Shaft of the Invention

| Serial No. | length (mm) | inner dia. (mm) | wall thickness(mm) | stiffness coefficient | linearity (mm) |
|---|---|---|---|---|---|
| Examp. 1 | 889 | 7.6 | 0.98 | 400 | 0.025 |
| Examp. 2 | 864 | 7.5 | 0.95 | 300 | 0.050 |
| Examp. 3 | 850 | 7.5 | 0.68 | 428 | 0.025 |
| Examp. 4 | 838 | 6.3 | 0.63 | 286 | 0.025 |
| Examp. 5 | 815 | 6.8 | 0.69 | 234 | 0.075 |
| Examp. 6 | 800 | 6.2 | 0.66 | 183 | 0.050 |
| Examp. 7 | 787 | 6.3 | 0.60 | 221 | 0.025 |
| Examp. 8 | 735 | 6.2 | 0.58 | 232 | 0.050 |
| Examp. 9 | 710 | 6.2 | 0.90 | 204 | 0.075 |
| Examp. 10 | 686 | 6.0 | 0.60 | 79 | 0.050 |
| Examp. 11 | 660 | 5.8 | 0.68 | 108 | 0.025 |
| Examp. 12 | 635 | 5.0 | 0.63 | 128 | 0.050 |
| Examp. 13 | 600 | 4.5 | 0.60 | 136 | 0.050 |
| Examp. 14 | 550 | 3.5 | 1.00 | 117 | 0.025 |
| Examp. 15 | 508 | 3.4 | 0.68 | 149 | 0.050 |

TABLE 2

Examples of the Parameters for Winding of the Arrow Shaft of the Invention

| | head section L1 | | tail section L3 | | winding | |
|---|---|---|---|---|---|---|
| serial No. | length | init. angle | length | ending angle | angles of section L2 | number of winding |
| Examp. 1 | 188 | 50 | 187 | 49 | 8 | 35 |
| Examp. 2 | 199 | 55 | 199 | 55 | 10 | 35 |
| Examp. 3 | 199 | 34 | 199 | 34 | 5 | 32 |
| Examp. 4 | 218 | 60 | 218 | 60 | 5 | 32 |
| Examp. 5 | 192 | 49 | 177 | 40 | 10 | 30 |
| Examp. 6 | 187 | 45 | 167 | 34 | 10 | 30 |
| Examp. 7 | 130 | 53 | 127 | 50 | 14 | 29 |
| Examp. 8 | 109 | 45 | 124 | 58 | 15 | 28 |
| Examp. 9 | 103 | 41 | 105 | 42 | 15 | 30 |
| Examp. 10 | 40 | 51 | 40 | 51 | 29 | 24 |
| Examp. 11 | 80 | 53 | 80 | 53 | 20 | 26 |
| Examp. 12 | 188 | 50 | 173 | 37 | 8 | 30 |
| Examp. 13 | 145 | 45 | 145 | 45 | 3 | 34 |
| Examp. 14 | 99 | 34 | 99 | 34 | 5 | 33 |
| Examp. 15 | 143 | 40 | 143 | 40 | 10 | 30 |

What is claimed is:

1. A carbon fiber arrow shaft comprising a hollow tube having a length between 500–900 mm, an inner diameter between 2–10 mm, and a tube wall thickness between 0.3–2 mm, a reinforced carbon fiber, and a resinoid binder, the reinforced carbon fiber binder forming a resin-impregnated carbon fiber, the carbon fiber arrow shaft being formed by directly and continuously winding said resin-impregnated carbon fiber around the hollow tube, said carbon fiber arrow shaft having a head section (L1), a middle section (L2) and a tail section (L3), a winding angle of the carbon fiber at the head section (L1) being changed from a larger winding angle to a smaller winding angle, a winding angle at the middle section (L2) being kept constant, and a winding angle at the tail section L3 being changed from a smaller winding angle to a larger winding angle, each of the lengths of the head section (L1) and the tail section (L3) being between 25–250 mm, the initial winding angle at the head section (L1) being between 30–90 degrees and being gradually decreased to between 2–30 degrees at the boundary of the head section (L1) and the middle section (L2), the winding angle at the middle section (L2) being kept constant, and the winding angle at the tail section (L3) being gradually increased from between 2–30 degrees at the boundary of the middle section (L2) and the tail section to between 30–90 degrees at the end of the tail section (L3), the winding angles at the head section (L1) and the tail section (L3) being at least two times of the winding angle at the middle section (L2).

2. The carbon fiber arrow shaft according to claim 1, wherein each of the lengths of the carbon fiber at the head section (L1) and the tail section (L3) is between 100–200 mm, the initial winding angle at the head section (L1) being between 40–60 degrees and being gradually decreased to between 5–10 degrees at the boundary of the head section (L1) and the middle section (L2), the winding angle at the middle section (L2) being kept constant, and the winding angle at the tail section (L3) being gradually increased from between 5–10 degrees at the boundary of the middle section (L2) and the tail section (L3) to between 40–60 degrees at the end of the tail section (L3).

3. A continuously winding method for carbon fiber arrow shaft including the following steps:

(1) selecting the materials of a carbon fiber and a binder, wherein the carbon fiber is 3–24K reinforced carbon fiber and the binder is a thermoset epoxy which is used for winding of the arrow shaft, said carbon fiber arrow shaft having a head section (L1), a middle section (L2) and a tail section (L3), each of the lengths of the head section (L1) and the tail section (L3) being between 25–250 mm;

(2) setting up a winding program for a winding machine, an initial winding angle at the head section (L1) being set between 30–90 degrees, and the winding angle being gradually decreased to between 2–30 degrees at the boundary of the head section (L1) and the middle section (L2), a winding angle at the middle section (L2) being kept constant, and a winding angle at the tail section (L3) being gradually increased from between 2–30 degrees at the boundary of the middle section (L2) and the tail section (L3) to between 30–90 degrees at the end of the tail section (L3), and the winding angles of the head section (L1) and the tail section (L3) being at least two times of that at the middle section (L2)

(3) initiating the winding machine to form a carbon fiber arrow shaft blank by continuously and directly winding the carbon fiber on an arrow shaft mandrel according to the preset winding program;

(4) unloading the arrow shaft blank from the winding machine.

4. The continuously winding method for the carbon fiber arrow shaft according to claim 3 wherein in the step of setting up the winding program, the lengths of the head section (L1) and the tail section (L3) are set in the range of 100–200 mm, the initial winding angle at the head section (L1) being between 40–60 degrees, and being gradually decreased to between 5–10 degrees at the boundary of the head section (L1) and the middle section (L2), the winding angle at the middle section (L2) being kept constant, and the winding angle at the tail section (L3) being gradually increased from between 5–10 degrees to between 40–60 degrees.

* * * * *